US012000243B2

(12) United States Patent
Xu et al.

(10) Patent No.: US 12,000,243 B2
(45) Date of Patent: Jun. 4, 2024

(54) COUNTER OBJECT, METHOD AND SYSTEM

(71) Applicants: YingQing Xu, Tomball, TX (US); Todd C. Jackson, Houston, TX (US); Eugene Stolboushkin, Houston, TX (US); Matthew D. Solfronk, Katy, TX (US)

(72) Inventors: YingQing Xu, Tomball, TX (US); Todd C. Jackson, Houston, TX (US); Eugene Stolboushkin, Houston, TX (US); Matthew D. Solfronk, Katy, TX (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 0 days.

(21) Appl. No.: 17/518,964

(22) Filed: Nov. 4, 2021

(65) Prior Publication Data

US 2023/0137410 A1 May 4, 2023

(51) Int. Cl.
*E21B 34/14* (2006.01)

(52) U.S. Cl.
CPC ..... *E21B 34/14* (2013.01); *E21B 2200/06* (2020.05)

(58) Field of Classification Search
CPC ..... E21B 34/14; E21B 2200/06
See application file for complete search history.

(56) References Cited

U.S. PATENT DOCUMENTS 2,928,470 A * 3/1960 Baker ..... E21B 34/14 166/194
2,978,028 A 4/1961 Webb et al.
3,055,430 A 9/1962 Campbell et al.
3,186,485 A 6/1965 Owen et al.
3,298,437 A 1/1967 Conrad et al.
3,356,389 A * 12/1967 Fredd ..... E21B 23/03 285/91

(Continued)

OTHER PUBLICATIONS

Notification of Transmittal of the International Search Report and the Written Opinion of the International Searching Authority, or the Declaration; PCT/US2022/048564; dated Mar. 10, 2023; 12 pages.

(Continued)

*Primary Examiner* — Dany E Akakpo
(74) *Attorney, Agent, or Firm* — CANTOR COLBURN LLP

(57) ABSTRACT

An object including a housing, a cone movably received in the housing, a piston body attached to the cone, a valve disposed as a part of the object and separating hydrostatic pressure from pressure at an interface between the housing and the piston body, and a trigger configured to open the valve at a selected circumstance. A method for moving a selected downhole tool including running an object into a borehole, counting features in the borehole using a sensor in the object, opening the valve at a selected count, flooding the interface with hydrostatic pressure, driving the piston body away from the housing, and moving a radially expandable shoulder member toward a larger diameter end of the cone. A borehole system including a borehole in a subsurface formation, a string disposed in the borehole, and an object disposed within or as a part of the string.

19 Claims, 6 Drawing Sheets

(56) References Cited

U.S. PATENT DOCUMENTS

| | | | | |
|---|---|---|---|---|
| 3,800,876 | A | 4/1974 | Eggleston | |
| 4,345,646 | A | 8/1982 | Terrell | |
| 4,507,957 | A * | 4/1985 | Montgomery | E21B 49/10 166/100 |
| 5,370,186 | A | 12/1994 | Ireland et al. | |
| 7,806,189 | B2 | 10/2010 | Frazier | |
| 9,683,419 | B2 | 6/2017 | Coon | |
| 9,810,035 | B1 | 11/2017 | Carr et al. | |
| 11,578,549 | B2 | 2/2023 | Eitschberger et al. | |
| 2004/0163809 | A1* | 8/2004 | Mayeu | E21B 47/09 166/334.1 |
| 2008/0230233 | A1 | 9/2008 | Fay et al. | |
| 2010/0065283 | A1* | 3/2010 | Hallundbaek | E21B 10/62 166/381 |
| 2013/0206402 | A1* | 8/2013 | Coon | E21B 34/14 166/305.1 |
| 2013/0255963 | A1 | 10/2013 | Guerrero et al. | |
| 2015/0252640 | A1 | 9/2015 | Mailand et al. | |
| 2015/0361761 | A1 | 12/2015 | Lafferty et al. | |
| 2017/0107803 | A1* | 4/2017 | Cedillo | F04B 47/12 |
| 2017/0254165 | A1 | 9/2017 | Coon | |
| 2020/0063553 | A1 | 2/2020 | Zemla et al. | |
| 2021/0140255 | A1 | 5/2021 | Greci et al. | |
| 2021/0156211 | A1 | 5/2021 | Arabskyy et al. | |
| 2023/0003094 | A1 | 1/2023 | Andres et al. | |

OTHER PUBLICATIONS

Notification of Transmittal of the International Search Report and the Written Opinion of the International Searching Authority, or the Declaration; PCT/US2022-048561; dated Mar. 13, 2023; 12 pages.

* cited by examiner

COUNTER OBJECT, METHOD AND SYSTEM

BACKGROUND

In the resource recovery and fluid sequestration industries, there often is need for action taken at specific places in a borehole. This may be, for example, that a specific number of Frac sleeves (stages) must be counted before one is actuated or may be that a number of sleeves related to other operations need to be counted to ensure that a desired sleeve is actuated. The number of stages that may be addressed in a single object run is generally limited due to various structural issues but the more stages in a frac operation, for example, that can be managed with a singe object run, the greater the efficiency of the operation. The art is always receptive to alternative configurations that improve efficiency.

SUMMARY

An embodiment of an object including a housing, a cone movably received in the housing, a piston body attached to the cone, a valve disposed as a part of the object and separating hydrostatic pressure from pressure at an interface between the housing and the piston body, and a trigger configured to open the valve at a selected circumstance.

An embodiment of a method for moving a selected downhole tool including running an object into a borehole, counting features in the borehole using a sensor in the object, opening the valve at a selected count, flooding the interface with hydrostatic pressure, driving the piston body away from the housing, and moving a radially expandable shoulder member toward a larger diameter end of the cone.

An embodiment of a borehole system including a borehole in a subsurface formation, a string disposed in the borehole, and an object disposed within or as a part of the string.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
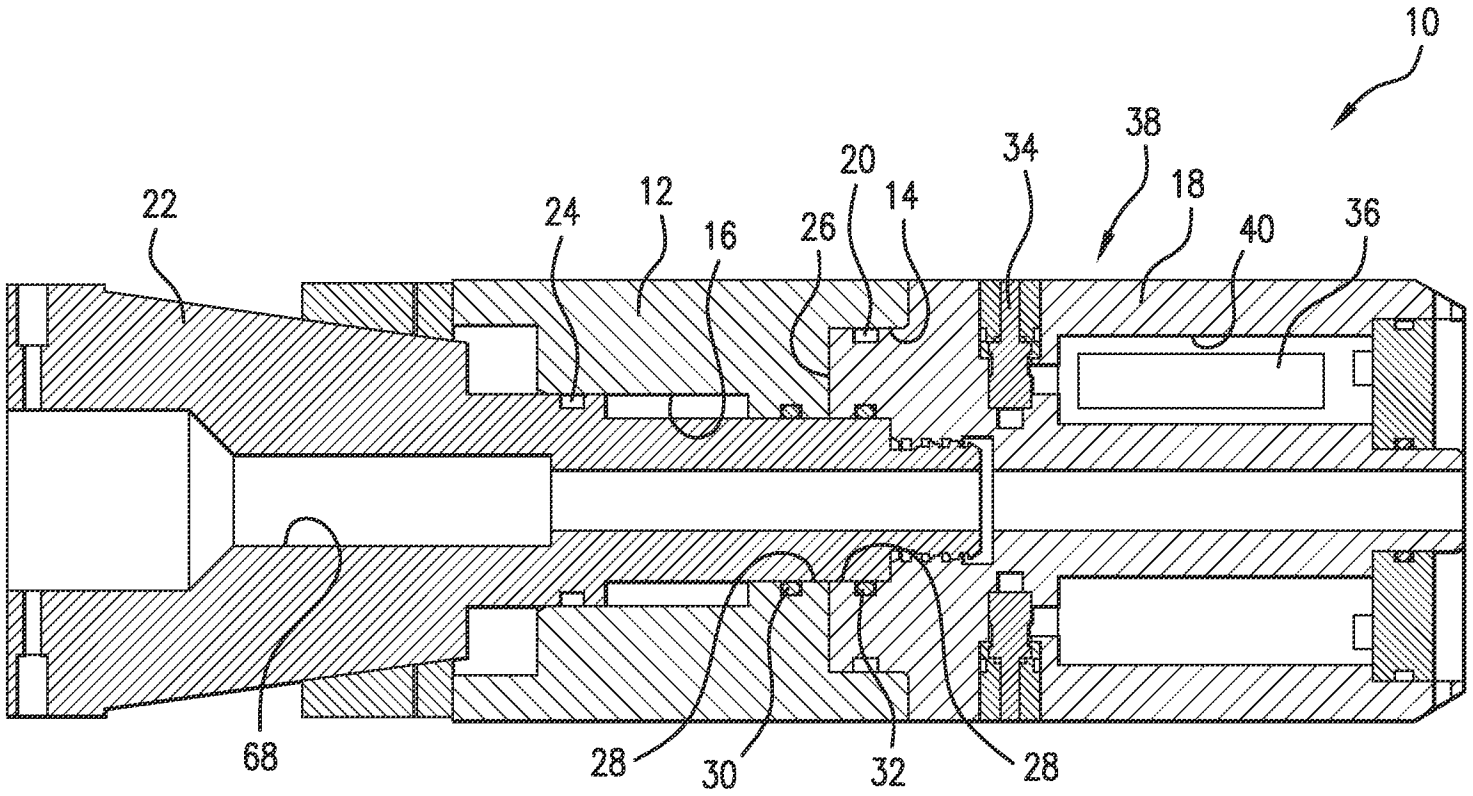
FIG. 1 is a cross sectional view of an object as disclosed herein.

Referring to FIG. 1, an object 10 is illustrated. The object is runnable in a borehole during use either on its own or in a tethered condition. The object 10 may in some instances be termed a "dart". The object 10 includes a housing 12 that features a piston body bore 14 and a cone bore 16. A piston body 18 is initially disposed partially in the piston body bore 14 and is sealed therein with a seal 20 such as for example on O-ring. A cone 22 is disposed within the cone bore 16 and sealed with seal 24, which also may be an O-ring. The housing 12 and piston body 18 together define an interface 26 and also together define an interface bore 28, which is sealed to the cone 22 via seals 30 and 32, which again may be O-rings. Within the object 10 and as illustrated within the piston body 18 (could be located in another place on object 10 such as in body 12) are disposed sensors 34 that act in concert with a controller 36 as a trigger 38 for the object 10 when certain selected circumstances are met. In an embodiment, these are non-contacting proximity sensors that sense metal objects within millimeters of a sensing aperture thereof (2, 3 or 5 mm, for example, sensing ranges for proximity sensors 34 are appropriate for purposes of this disclosure). It is contemplated that two or more sensors 34 may be employed but also contemplated that three or more will provide greater confidence of a count. In an embodiment, there are four sensors 34 disposed in the piston body 18 90 degrees apart from one another about the periphery of the piston body 18. Employing four or more sensors 34 enhances proximity sensor accuracy. During use, when the object comes into proximity with a feature downhole such as a frac sleeve or other tool, which is of smaller inside diameter than a string in which the tool is disposed, the proximity sensors will register a signal that is counted in the controller 36 that may be a part of the sensors 34 or may be configured as a separate unit disposed in the object 10 (illustrated for example only in a recess 40 of piston body 18).

Figure 2:
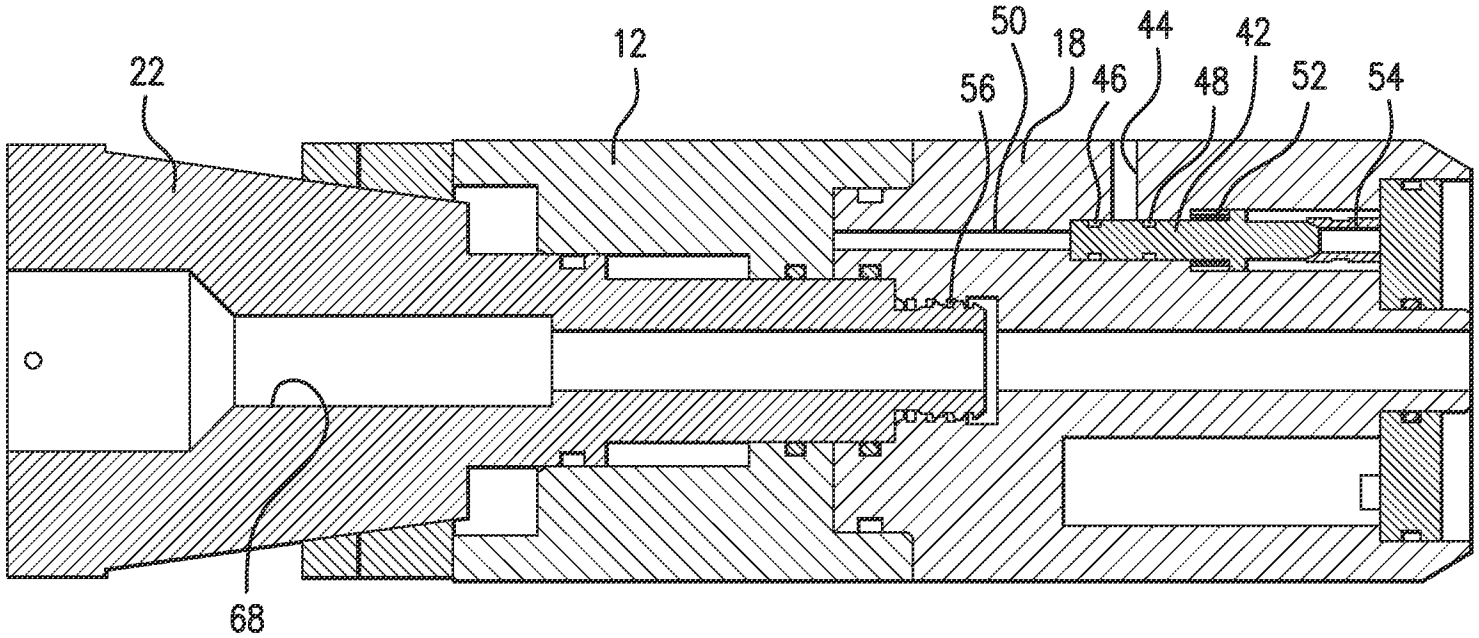
FIG. 2 is a cross sectional view of the same object illustrated in FIG. 1 but with the cross section taken after rotating the object along its own longitudinal axis 90 degrees.

Referring now to FIG. 2, and reminding the reader that FIG. 2 is a cross section of the object 10 rotated 90 degrees from the FIG. 1 view, a valve 42 is now visible in the piston body 18. The valve is initially disposed to close a port 44 in piston body 18. The valve 42 includes seals 46 and 48 that straddle the port 44 and thereby prevent hydrostatic pressure from entering an interface feed 50. The valve includes a biaser 52, such as a spring device (coil spring, leaf spring, rubber, compressed gas, etc,), that biases the valve 42 to a position where port 44 is fluidly connected with interface feed 50. The biaser 52, such as a spring device, cannot achieve the fluid connection until a designated signal from the controller 36 to release a stop 54. The stop 54 may be of a number of constructions that physically interferes with the ability of the valve 42 to move to the right in the Figure and to an open position. One construction of stop 54 may be a multipiece structure that is held together with a for example an aramid fiber wire, that may be severed by an electrical current supplied thereto by the controller 36 upon reaching a selected count. Upon severing the wire, the stop 54 falls apart and the valve 42 is free to move under the bias of the biaser 52. Clearly other stop mechanisms known to the art could be substituted.

Figure 3:
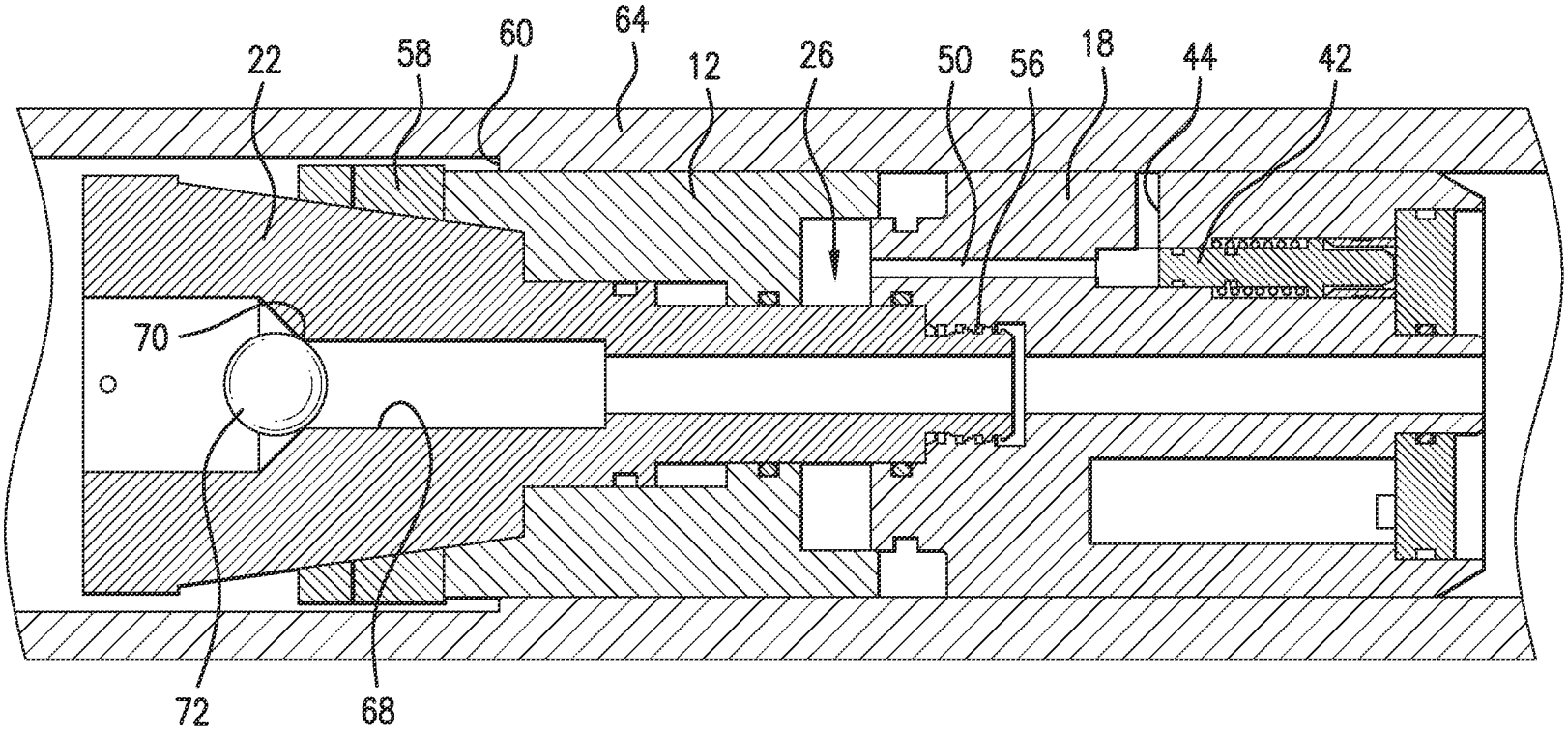
FIG. 3 is the view of FIG. 2 in a set position.

Referring to FIG. 3, the object 10 is illustrated close in a set position, meaning it is in the position required after the controller 36 achieves the selected circumstance (which may be a count) and the hydraulic pressure is fluidly connected from port 44 to the interface 26. It will be appreciated that piston body 18 has shifted away from the housing 12 and dragged cone 22 with it. The piston body 18 and cone 22 are attached to one another by suitable mechanical connection such as thread 56 or by a bonding connection such as by welding or adhesive in the same place as the thread 56 is located. This is occasioned by the valve 42 moving rightwardly in the figure, away from the housing 12 whereby hydraulic fluid in the environment outside of the object 10 is allowed to communicate through port 44 to the interface feed 50 and hence to the interface 26. Hydraulic pressure in the interface 26 is opposed across seals 30 and 32 to a pressure contained within the object 10 during its construction, normally atmospheric pressure. Because of this pressure mismatch across these seal areas, the piston body 18 is moved away from the housing 12 and draws the cone 22 further into the housing 12. As cone 22 is drawn into housing 12, a radially expandable shoulder member 58, which may be a split ring, C ring, helical cut backup ring, etc. disposed about the cone 22 is forced to move along the cone 22 to a portion thereof with a larger diameter. This causes the member 58 to expand radially and be able to land on a feature 60, which may be a sleeve or other tool that requires movement, in a string or borehole 62 radially outwardly of the feature 60 that is to be moved. In the illustration, the feature 60 is a step of a sleeve 64 that may be a frac sleeve in some embodiments but could also be other tools that require movement. Feature 60 could also be the end of the sleeve. Once landed, pressure uphole of the object 10 may be increased to thereby move the movable feature 60, as illustrated, moving the sleeve 64 relative to the borehole 62 or string 66. It is also important to note that the object 10 includes a through bore 68 that allows for fluid flow through the object 10 if need be and so the object 10 is provided with a seat 70 for a drop ball 72 (that may be run with the object 10 or dropped afterward) or for a flapper (not shown but well known to those of skill in the art). With the ball 72 on seat 70 as illustrated, pressure uphole will cause the desired movement of the feature 60 along with sleeve 62.

Figure 4:
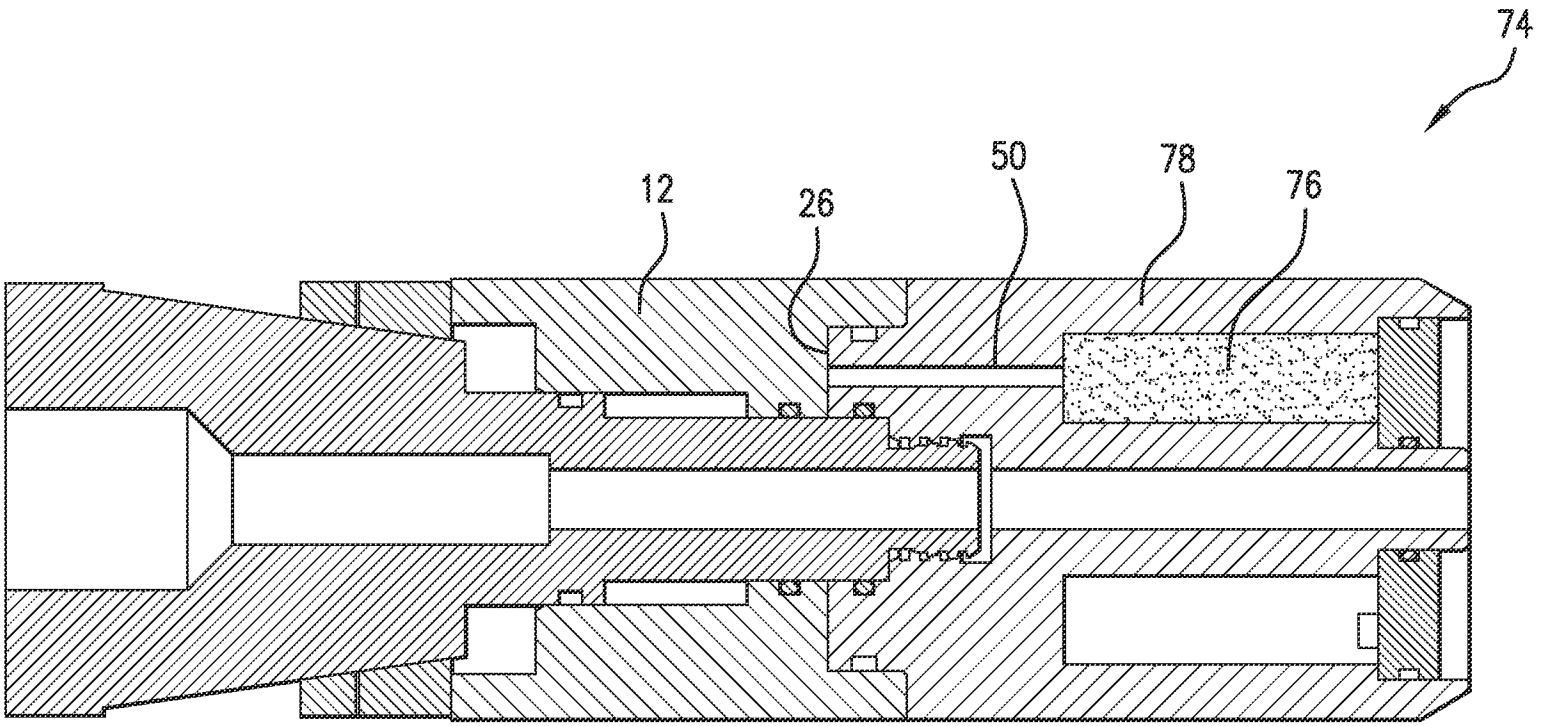
FIG. 4 is a view of another embodiment of an object as disclosed herein.

Referring to FIG. 4, another embodiment, object 74 is illustrated that employs substantially the same structure as the embodiment of FIG. 1 but uses a gas evolving compound to create motive force as opposed to the hydrostatic pressure working against a lower (Ex. Atmospheric) pressure of the embodiment of FIG. 1. Accordingly, in the embodiment of FIG. 4 there is no need for port 44 and it has been eliminated or plugged in this embodiment. Further, the valve 42 is removed. Rather, in the same space or similar space as housed the valve 42 of FIG. 1, there is in the embodiment of FIG. 4 a compound 76 that will evolve gas upon command. Suitable compounds include: Gun powder, including a black powder charge that is glued together into a form, various perchlorate mixtures, such as Aluminum with Aluminum perchlorate, explosives such as RDX (Hexahydro-1,3,5-trinitro-1,3,5-triazine) and HMX (1,3,5,7-tetranitro-1,3,5,7-tetrazacyclooctane), among others.

Due to this distinction, the piston body for this embodiment is identified with numeral 78. The command may be an electrical command, pursuant to the same count occasioned by the same proximity sensors discussed above, that ignites the compound 76, in embodiments. Upon ignition, the compound 76 evolves gas that is conveyed to the interface 26 through interface feed 50. The evolving gas need only develop pressure sufficient to overcome the atmospheric pressure in the object 74, which pressure is as was described above for object 10. Action of the object 74 is otherwise the same as object 10.

Figure 5:
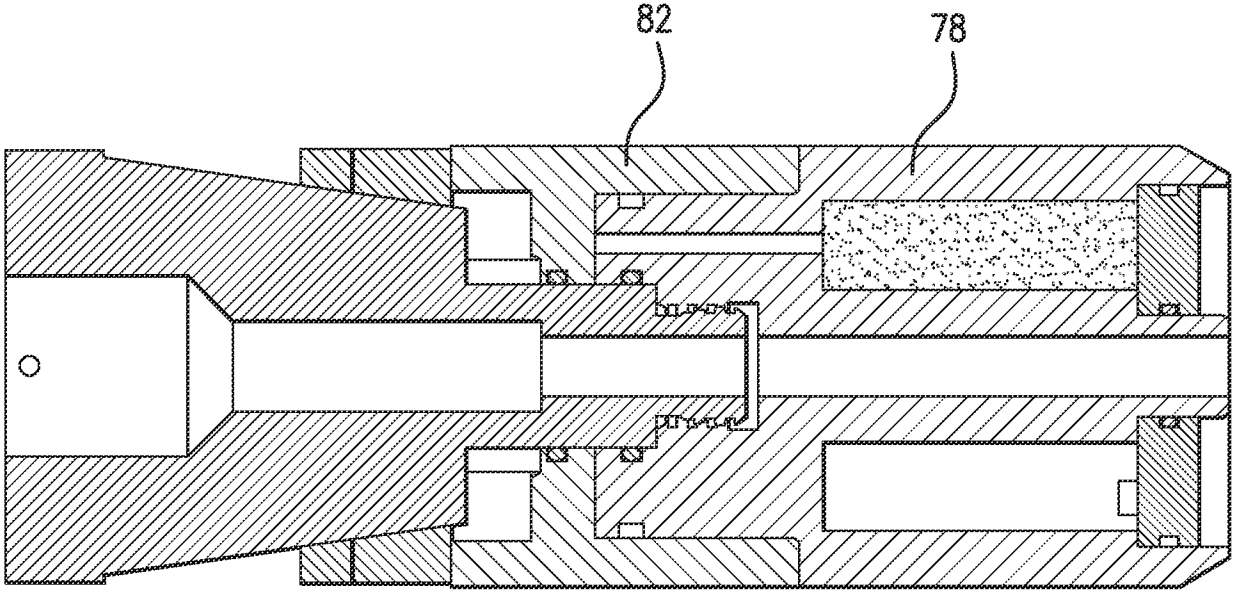
FIG. 5 is yet another embodiment of an object as disclosed herein.

Referring to FIG. 5, yet another embodiment is illustrated. In this embodiment, an object 80 is illustrated that is similar to the foregoing objects 10 and 74 but lacks a low-pressure (e.g., atmospheric pressure) internal containment. None is to be used in this embodiment and hence none is needed for this embodiment. Object 80 includes the same piston body 78 from the embodiment of FIG. 4 but a different housing from each of the foregoing embodiments. Housing 82 lacks cone bore 16 from FIG. 1 since that space, held at a lower pressure, is no needed in this embodiment. This allows for the overall length of the object 80 to be slightly less that the previous embodiments. In other respects, the object 80 functions as do the foregoing embodiments with the distinction being that the compound 76 must in the embodiment of FIG. 5 evolve sufficient gas to create a pressure that exceeds hydrostatic pressure in the location of actuation rather than just to exceed the atmospheric pressure in the embodiment of FIG. 4.

Figure 6:
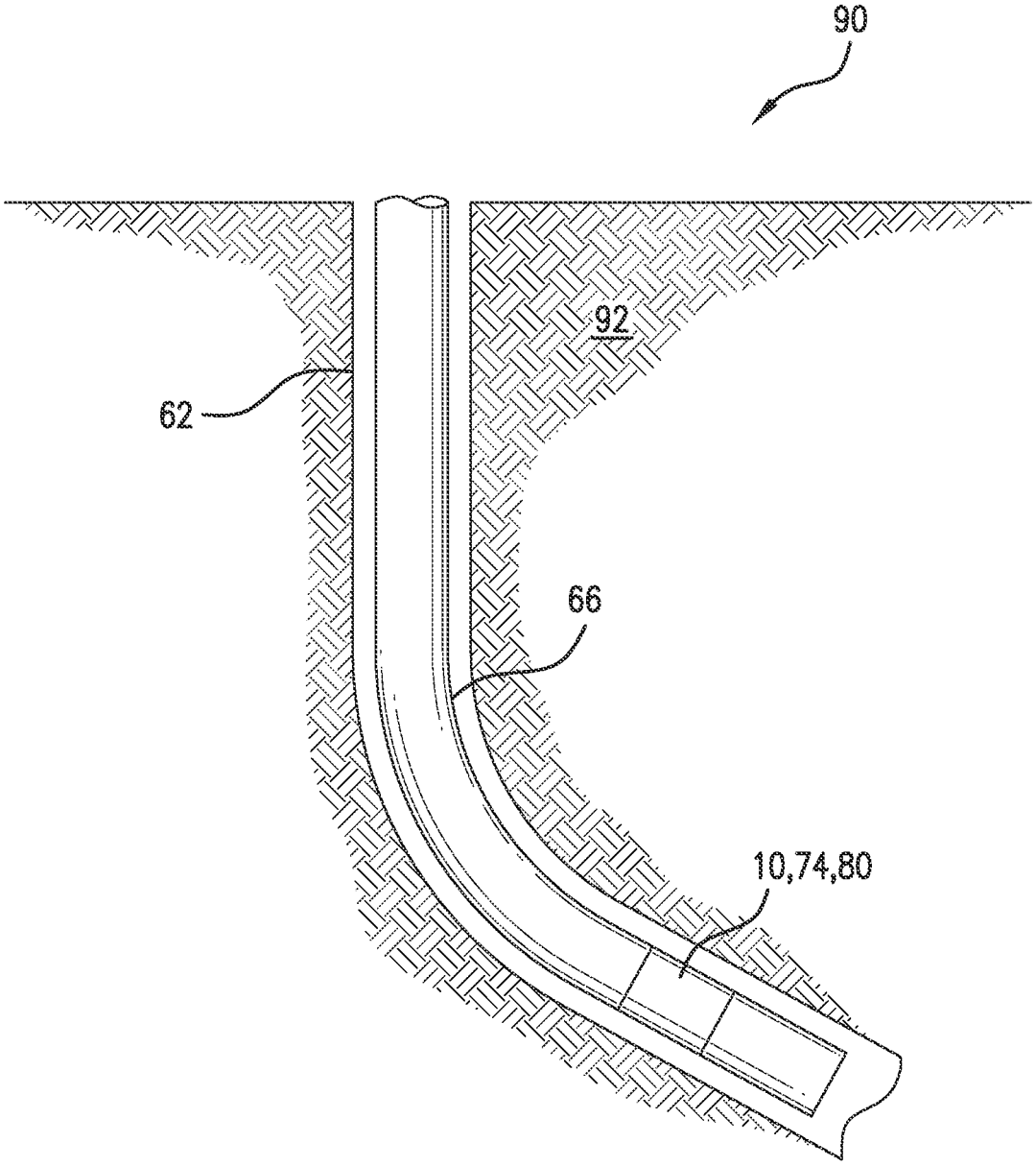
FIG. 6 is a view of a borehole system including the object as disclosed herein.

Referring to FIG. 6, a borehole system 90. The system 90 includes the borehole 62 that extends within a subsurface formation 92. A string 66 is disposed within the borehole 62. Disposed within or as a part of the string 66 is an object 10, 74 or 80 as disclosed herein.

Set forth below are some embodiments of the foregoing disclosure:

Embodiment 1: An object including a housing, a cone movably received in the housing, a piston body attached to the cone, a valve disposed as a part of the object and separating hydrostatic pressure from pressure at an interface between the housing and the piston body, and a trigger configured to open the valve at a selected circumstance.

Embodiment 2: The object as in any prior embodiment further including a radially expandable shoulder member.

Embodiment 3: The object as in any prior embodiment wherein the member is a helically split ring.

Embodiment 4: The object as in any prior embodiment wherein the trigger including a sensor and a controller assembled in one or more units.

Embodiment 5: The object as in any prior embodiment wherein the sensor is a proximity sensor.

Embodiment 6: The object as in any prior embodiment wherein the sensor is a plurality of sensors distributed about the object.

Embodiment 7: The object as in any prior embodiment wherein the plurality is greater than 3 sensors.

Embodiment 8: The object as in any prior embodiment wherein the plurality is four sensors located 90 degrees apart from one another.

Embodiment 9: The object as in any prior embodiment wherein the valve comprises a piston.

Embodiment 10: The object as in any prior embodiment wherein the selected circumstance is a selected number of proximity sensor signals.

Embodiment 11: The object as in any prior embodiment wherein the valve is restrained to a closed position by a stop releasable by the controller.

Embodiment 12: The object as in any prior embodiment wherein the object maintains a build environment pressure within the object against which hydrostatic pressure acts when triggered during use.

Embodiment 13: The object as in any prior embodiment wherein the build environment pressure is atmospheric pressure.

Embodiment 14: A method for moving a selected downhole tool including running an object as in any prior embodiment into a borehole, counting features in the borehole using a sensor in the object, opening the valve at a selected count, flooding the interface with hydrostatic pressure, driving the piston body away from the housing, and moving a radially expandable shoulder member toward a larger diameter end of the cone.

Embodiment 15: The method as in any prior embodiment wherein the counting includes sensing proximity to the features with a plurality of sensors at the same time.

Embodiment 16: The method as in any prior embodiment wherein the sensing is noncontact.

Embodiment 17: The method as in any prior embodiment further including landing the expandable shoulder member on a feature subsequent to obtaining a selected count of features.

Embodiment 18: The method as in any prior embodiment further including pressuring on the object to move the feature.

Embodiment 19: The method as in any prior embodiment wherein the feature is a frac sleeve.

Embodiment 20: A borehole system including a borehole in a subsurface formation, a string disposed in the borehole, and an object as in any prior embodiment disposed within or as a part of the string.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The terms "about", "substantially" and "generally" are intended to include the degree of error associated with measurement of the particular quantity based upon the equipment available at the time of filing the application. For example, "about" and/or "substantially" and/or "generally" can include a range of ±8% or 5%, or 2% of a given value.

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. An object comprising:

a housing;

a cone movably received in the housing;

a piston body fixedly attached to the cone such that movement of the piston body causes the same movement of the cone relative to the housing;

a valve disposed as a part of the object and separating hydrostatic pressure from pressure at an interface between the housing and the piston body; and a trigger configured to open the valve at a selected circumstance, the trigger including a proximity sensor configured to sense a feature in a downhole environment and register a count.

2. The object as claimed in claim 1 further including a radially expandable shoulder member.

3. The object as claimed in claim 2 wherein the member is a helically split ring.

4. The object as claimed in claim 1 wherein the trigger further comprises:

a controller assembled in one or more units.

5. The object as claimed in claim 4 wherein the valve is restrained to a closed position by a stop releasable by the controller.

6. The object as claimed in claim 1 wherein the proximity sensor is a plurality of proximity sensors distributed about the object.

7. The object as claimed in claim 6 wherein the plurality is greater than 3 sensors.

8. The object as claimed in claim 6 wherein the plurality is four proximity sensors located 90 degrees apart from one another.

9. The object as claimed in claim 1 wherein the valve comprises a piston.

10. The object as claimed in claim 1 wherein the selected circumstance is a selected number of proximity sensor signals.

11. The object as claimed in claim 1 wherein the object maintains a build environment pressure within the object against which hydrostatic pressure acts when triggered during use.

12. The object as claimed in claim 11 wherein the build environment pressure is atmospheric pressure.

13. A method for moving a selected downhole tool comprising:

running an object having a housing, a cone movably received in the housing;

a piston body fixedly attached to the cone such that the movement of the piston body causes the same movement of the cone relative to the housing;

a valve disposed as a part of the object and separating hydrostatic pressure from pressure at an interface between the housing and the piston body; and a trigger configured to open the valve at a selected circumstance into a borehole;

counting features in the borehole using a sensor in the object;

opening the valve at a selected count;

flooding the interface with hydrostatic pressure;

driving the piston body away from the housing; and moving a radially expandable shoulder member toward a larger diameter end of the cone.

14. The method as claimed in claim 13 wherein the counting includes sensing proximity to the features with a plurality of sensors at the same time.

15. The method as claimed in claim 14 wherein the sensing is noncontact.

16. The method as claimed in claim 13 further comprising:

landing the expandable shoulder member on a feature subsequent to obtaining a selected count of features.

17. The method as claimed in claim 16 further including pressuring on the object to move the feature. sleeve.

18. The method as claimed in claim 17 wherein the feature is a frac sleeve.

19. A borehole system comprising:

a borehole in a subsurface formation;

a string disposed in the borehole; and an object as claimed in claim 1 disposed within or as a part of the string.

* * * * *